US011198926B2

(12) United States Patent
Fine et al.

(10) Patent No.: US 11,198,926 B2
(45) Date of Patent: Dec. 14, 2021

(54) ALLOYS AND METHODS OF FORMING SAME

(71) Applicant: NORTHWESTERN UNIVERSITY, Evanston, IL (US)

(72) Inventors: Morris E. Fine, Wilmette, IL (US); Semyon Vaynman, Highland Park, IL (US); Evan T. Hunt, Appleton, WI (US); Akio Urakami, Tokyo (JP); Yip-Wah Chung, Wilmette, IL (US); Johannes Weertman, Evanston, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 274 days.

(21) Appl. No.: 14/571,844

(22) Filed: Dec. 16, 2014

(65) Prior Publication Data

US 2015/0167128 A1 Jun. 18, 2015

Related U.S. Application Data

(60) Provisional application No. 61/916,944, filed on Dec. 17, 2013.

(51) Int. Cl.
*C22C 23/04* (2006.01)
*C22F 1/00* (2006.01)
(Continued)

(52) U.S. Cl.
CPC ..... *C22C 23/04* (2013.01); *C22C 16/00* (2013.01); *C22C 19/03* (2013.01); *C22C 21/00* (2013.01);
(Continued)

(58) Field of Classification Search
CPC ..... C22C 23/00; C22C 23/04; C22C 1/0458; C22C 14/00; C22C 27/06; C22C 19/03; C22C 21/00; C22F 1/002; C22F 1/06
See application file for complete search history.

(56) References Cited

U.S. PATENT DOCUMENTS 3,404,048 A * 10/1968 Stratford ..... C22C 23/04 148/406
2003/0000608 A1* 1/2003 Horie ..... C22C 23/04 148/666
(Continued)

FOREIGN PATENT DOCUMENTS

JP H06200348 * 7/1994
SU 924141 * 4/1982

OTHER PUBLICATIONS

Bolobov, V.I. "Possible mechanism of autoignition of titanium alloys in oxygen." 2003. Combustion, explosion, and shock waves. 39. p. 677-680. (Year: 2003).*
(Continued)

*Primary Examiner* — Nicholas A Wang
(74) *Attorney, Agent, or Firm* — Locke Lord LLP; Tim Tingkang Xia, Esq.

(57) ABSTRACT

In one aspect of the invention, an alloy includes a first element comprising magnesium (Mg), titanium (Ti), zirconium (Zr), chromium (Cr), or nickelaluminum (NiAl), a second element comprising lithium (Li), calcium (Ca), manganese (Mn), aluminum (Al), or a combination thereof, and a third element comprising zinc (Zn). According to the invention, nanoscale precipitates is produced in the magnesium alloy by additions of zinc and specific heat-treatment. These precipitates lower the energy for dislocation movements and increase the number of available slip systems in
(Continued)

the magnesium alloy at room temperature and hence improve ductility and formability of the magnesium alloy.

3 Claims, 4 Drawing Sheets

(51) Int. Cl.

| | |
|---|---|
| ***C22F 1/06*** | (2006.01) |
| ***C22C 23/00*** | (2006.01) |
| ***C22C 16/00*** | (2006.01) |
| ***C22C 27/06*** | (2006.01) |
| ***C22C 21/00*** | (2006.01) |
| ***C22C 19/03*** | (2006.01) |
| *C22C 21/10* | (2006.01) |

(52) U.S. Cl.
CPC ..... *C22C 23/00* (2013.01); *C22C 27/06* (2013.01); *C22F 1/002* (2013.01); *C22F 1/06* (2013.01); *C22C 21/10* (2013.01)

(56) References Cited

U.S. PATENT DOCUMENTS

2003/0062261 A1* 4/2003 Shindo ..... C22B 34/14
204/298.13
2013/0039805 A1* 2/2013 Somekawa ..... C22C 23/02
420/408
2014/0308157 A1* 10/2014 Yamakawa ..... C22F 1/06
420/407
2015/0129092 A1* 5/2015 Mueller ..... C22C 23/04
148/538

OTHER PUBLICATIONS

J. Weertman, Mason's Dislocation Relaxation Mechansim, Phys. Rev., 1956, vol. 101, pp. 1429-1430.
J. Weertman, Dislocation Model of Low-Temperature Creep, J Appl. Phys., 1958, vol. 29, pp. 1685-1687.
A. Urakami, Effect of Lithium Additions on Mechanical Properties of Mg Base Single Crystals in Basal and Prismatic Slip, Ph.D. Dissertation, Northwestern University, Evanston, IL, 1970.
A. Urakami and M.E. Fine, Influence of Misfit Centers on Formation of Helical Dislocations, Scripta Metall., 1970, vol. 4, pp. 667-672.
M. E. Fine, S. Vaynman, D. Isheim, Y-W. Chung, S. P. Bhat, C. H. Hahin, A New Paradigm for Designing High-Fracture-Energy Steels, Metall. Mater. Trans. A, 2010, vol. 41A, pp. 3318-3325.

* cited by examiner (a)

ALLOYS AND METHODS OF FORMING SAME

CROSS-REFERENCE TO RELATED PATENT APPLICATION

This application claims priority to and the benefit of, pursuant to 35 U.S.C. § 119(e), U.S. provisional patent application Ser. No. 61/916,944, filed Dec. 17, 2013, entitled "METHOD FOR IMPROVING FORMABILITY OF HEXAGONAL MAGNESIUM ALLOYS", by Morris E. Fine, Semyon Vaynman, Evan T. Hunt, Akio Urakami, Yip-Wah Chung and Johannes Weertman, which is incorporated herein in its entirety by reference.

Some references, which may include patents, patent applications, and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference. In terms of notation, hereinafter, "[n]" represents the nth reference cited in the reference list. For example, [5] represents the 5th reference cited in the reference list, namely, M. E. Fine, S. Vaynman, D. Isheim, Y-W. Chung, S. P. Bhat, C. H. Hahin: Metall. Mater. Trans. A, 2010, vol. 41A, pp. 3318-25.

FIELD OF THE INVENTION

The present application relates generally to alloys, and more particularly to alloys of magnesium (Mg), titanium (Ti), zirconium (Zr), chromium (Cr), or nickelaluminum (NiAl), with additions of lithium (Li), calcium (Ca), manganese (Mn), aluminum (Al), or a combination thereof, and zinc (Zn), and method of forming the same.

BACKGROUND

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

With the increasing global concern for energy usage and the environment, there is a need for ultra-lightweight structural materials. Because magnesium (Mg) is 36% less dense than aluminum (Al), Mg-based alloys have received considerable attention over the last decade, primarily for use in the automotive and aerospace industries. According to the US Automotive Materials Partnership, an average car is projected to have 160 kg of Mg-alloy parts by 2020 resulting in 15% weight reduction. Each 10% reduction in weight results in fuel efficiency improvement of 7%. Despite the intrinsic advantage of Mg, a serious limiting property of hexagonal Mg and its alloys are their poor ductility and formability at ambient temperature. Because of its hexagonal crystal structure, Mg and its current alloys crack easily thus lack the needed ductility and formability at ambient temperature. Therefore, they are mainly used as-cast or they are formed (pressed, stamped, etc.) at elevated temperatures. Most current applications use Mg alloys in the cast condition which have poor tensile ductility of less than 5%. The best extrusion alloys have ductility in the range of 15-20%. Although significant progress has been made in achieving competitive levels of strength, these alloys do not have sufficient ductility to be mechanically formed at ambient temperature into complex shapes as required by many automobile and aircraft components. A low-cost Mg alloy with sufficient strength and enhanced ductility at ambient temperature would be of great use to many manufacturers concerned with conserving weight. However, at the present time, without the use of rare-earth elements, no other Mg-based alloys are formable at ambient temperature.

Therefore, a heretofore unaddressed need exists in the art to address the aforementioned deficiencies and inadequacies.

SUMMARY OF THE INVENTION

One of the objectives of the invention is to provide alloys that are highly formable and ductile at room temperature and a method of forming the same. According to the invention, nanoscale precipitates are produced in the alloy matrix by addition of alloying elements and by specific heat-treatment. These precipitates lower the energy for dislocation movement and increase the number of available slip systems in magnesium alloy at room temperature and hence improve ductility and formability. Generally, it works for any alloy system with precipitates that are co-planar and small.

In one aspect, the invention relates to a magnesium (Mg) alloy. In one embodiment, the Mg alloy includes a first element comprising Mg, a second element, and a third element. In one embodiment, the Mg alloy consists essentially of the first element, the second element, and the third element.

In one embodiment, the second element comprises lithium or calcium, and the third element comprises zinc.

In one embodiment, the content of the second element is at most about 5.0 wt % of the magnesium alloy, and the content of the third element is at most about 10.0 wt % of the magnesium alloy.

In one embodiment, the content of the lithium is at most about 3.0 wt % of the magnesium alloy, and the content of the zinc is at most about 6.0 wt % of the magnesium alloy.

In another embodiment, the content of the lithium is at most about 2.4 wt % of the magnesium alloy, and the content of the zinc is at most about 5.1 wt % of the magnesium alloy.

In one embodiment, the content of the calcium is at most about 2.0 wt % of the magnesium alloy, and the content of the zinc is at most about 6.0 wt % of the magnesium alloy.

In another embodiment, the content of the calcium is at most about 1.0 wt % of the magnesium alloy, and the content of the zinc is at most about 1.0 wt % of the magnesium alloy.

In another aspect, the invention relates to an alloy. In one embodiment, the alloy includes a first element comprising a metal having a hexagonal close-packed (HCP) crystal structure with a basal slip system and non-basal slip systems, where the non-basal slip systems include a prismatic and pyramidal slip, a second element adapted to activate the non-basal slip systems by mobilizing the prismatic and pyramidal slip, and a third element adapted to form nanoscale precipitates in the alloy so as to enhance ambient-temperature formability and ductility of the alloy.

In one embodiment, the nanoscale precipitates comprise nanoscale coherent and co-planar misfit precipitates.

In one embodiment, the content of the second element is at most about 5.0 wt % of the alloy, and the content of the third element is at most about 10.0 wt % of the alloy.

In one embodiment, the first element comprises magnesium, titanium, zirconium, chromium, or nickelaluminum (NiAl).

In one embodiment, the second element comprises a non-HCP metal.

In one embodiment, the second element comprises lithium, calcium, manganese, or aluminum, or a combination thereof, and the third element comprises zinc.

In one embodiment, the content of the lithium is at most about 3.0 wt % of the alloy, and the content of the zinc is at most about 6.0 wt % of the alloy.

In another embodiment, the content of the lithium is at most about 2.4 wt % of the alloy, and the content of the zinc is at most about 5.1 wt % of the alloy.

In one embodiment, the content of the calcium is at most about 2.0 wt % of the magnesium alloy, and the content of the zinc is at most about 6.0 wt % of the alloy In another embodiment, the content of the calcium is at most about 1.0 wt % of the magnesium alloy, and the content of the zinc is at most about 1.0 wt % of the alloy.

In yet another aspect, the invention relates to a method of forming an alloy with enhanced ambient-temperature formability and ductility. In one embodiment, the method comprises the steps of forming a molten mass of the first element, the second element and the third element, cooling the molten mass to form a solid mass, solutionizing the solid mass at a first temperature for a first period of time, immediately followed by water-quenching, and heat-treating the mass at a second temperature for a second period of time to form nanoscale precipitates in the alloy.

In one embodiment, the forming step comprises the step of adding an amount of the second element into an alloy of the first element to form an alloy of the first and second elements, and adding an amount of the third element in the alloy of the first and second elements.

In one embodiment, the first element comprising a metal having a hexagonal close-packed (HCP) crystal structure with a basal slip system and non-basal slip systems, wherein the non-basal slip systems comprises a prismatic and pyramidal slip, the second element is adapted to activate the non-basal slip systems by mobilizing the prismatic and pyramidal slip, and the third element is adapted to form the nanoscale precipitates in the alloy for enhancing ambient-temperature formability and ductility of the alloy.

In one embodiment, the first element comprises magnesium, titanium, zirconium, chromium, or nickelaluminum (NiAl). In one embodiment, the second element comprises a non-HCP metal.

In one embodiment, the content of the second element is at most about 5.0 wt % of the alloy, and the content of the third element is at most about 10.0 wt % of the alloy.

In one embodiment, the second element comprises lithium, calcium, manganese, or aluminum, or a combination thereof, and the third element comprises zinc.

In one embodiment, the content of the lithium is at most about 3.0 wt % of the alloy, and the content of the zinc is at most about 6.0 wt % of the alloy.

In another embodiment, the content of the lithium is at most about 2.4 wt % of the alloy, and the content of the zinc is at most about 5.1 wt % of the alloy.

In one embodiment, the content of the calcium is at most about 2.0 wt % of the alloy, and the content of the zinc is at most about 6.0 wt % of the alloy.

In another embodiment, the content of the calcium is at most about 1.0 wt % of the alloy, and the content of the zinc is at most about 1.0 wt % of the alloy.

In one embodiment, the first temperature is in a range of about 300-400° C., preferably, about 350° C., and wherein the first period of time is in a range of about 72-168 hours, preferably, about 120 hours.

In one embodiment, the second temperature is in a range of about 100-200° C., preferably, about 150° C., and wherein the second period of time is in a range of about 1-50 hours, preferably, about 4-35 hours.

These and other aspects of the present invention will become apparent from the following description of the preferred embodiments taken in conjunction with the following drawings, although variations and modifications thereof may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
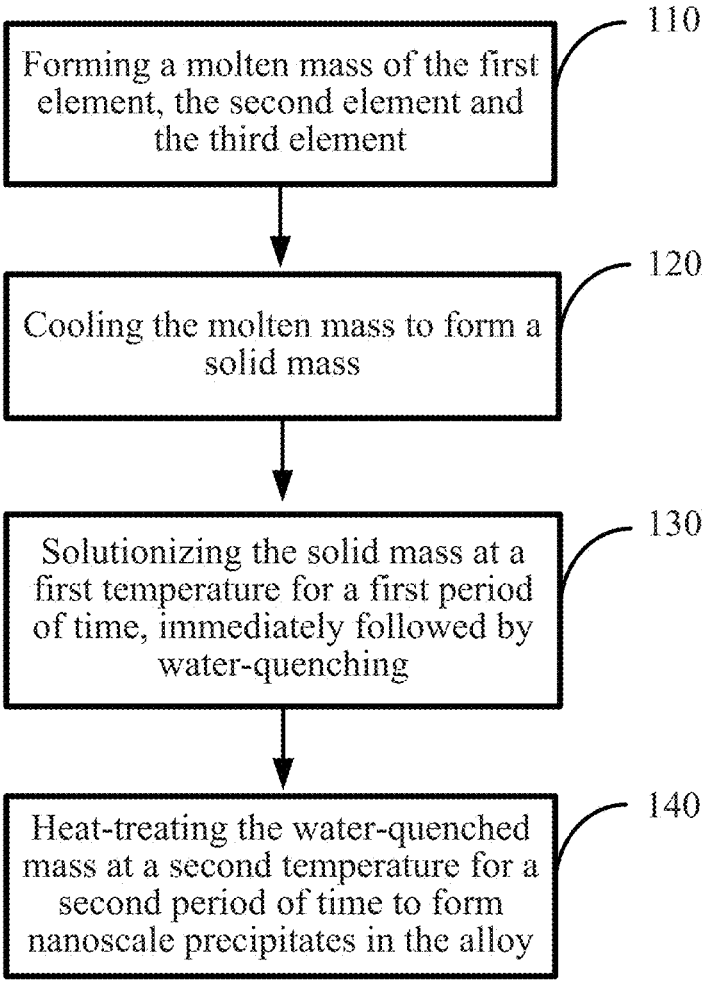
FIG. 1 shows a flowchart of the process for forming an alloy according to one embodiment of the present invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term are the same, in the same context, whether or not it is highlighted. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present there between. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top", may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower" can, therefore, encompass both an orientation of "lower" and "upper", depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about", "substantially" or "approximately" can be inferred if not expressly stated.

As used herein, the terms "comprise" or "comprising", "include" or "including", "carry" or "carrying", "has/have" or "having", "contain" or "containing", "involve" or "involving" and the like are to be understood to be open-ended, i.e., to mean including but not limited to.

The description is now made as to the embodiments of the invention in conjunction with the accompanying drawings. In accordance with the purposes of this invention, as embodied and broadly described herein, this invention, in one aspect, relates to Mg alloys with additions of nanoscale precipitates so at to enhance their ambient-temperature formability and ductility, and a method of forming the same. Although various exemplary embodiments of the invention disclosed herein may be described in the context of Mg alloys with additions of lithium (Li) and zinc (Zn), or additions of calcium (Ca) and Zn, it should be appreciated that aspects of the invention disclosed herein are not limited to being used in connection with the particular types of Mg alloys with additions of Li and Zn, or additions of Ca and Zn and may be practiced in connection with other types of alloys with enhanced ambient-temperature formability and ductility without departing from the scope of the invention disclosed herein.

The ductile-to-brittle transition (DBTT) in steels depends on the interplay between flow stress and fracture stress. In ferritic steels, the mobility of screw dislocations and consequently the flow stress depend strongly on temperature and strain rate. In contrast, the fracture stress usually is assumed to be independent of the temperature and the strain rate. At high temperatures (usually above room temperature) and low strain rates, thermal energy is sufficient to activate the motion of screw dislocations, resulting in plastic flow at stresses below the fracture stress. However, as one lowers the temperature, less thermal energy is available, and higher stress is required to activate the motion of screw dislocations. Therefore, the flow stress increases with decreasing temperature. As a result, the flow stress curve intersects the fracture stress at a critical temperature, below which the steel suffers brittle fracture before yielding. The critical temperature is the DBTT temperature. The DBTT increases with the strain rate.

The Peierls stress (i.e., the force required to move a dislocation from a low energy valley over an energy hill to the next low energy valley) to move a long dislocation segment from a crystallographic energy valley in body-centered cubic (BCC) metals is large. Weertman proposed that a high Peierls energy dislocation likely would move by first forming a double kink [1]. In the BCC metals, the kink sides are in an edge dislocation orientation and are thus very mobile. Subsequently, Weertman suggested that a solute atom (or clusters of solute atoms) misfit center would interact with a dislocation to help pull it from its Peierls energy valley [2], and showed that nanoscale coherent and coplanar precipitates (strain centers) react with neighboring dislocations to locally lower their Peierls stress [1, 2]. Dislocations with high Peierls stress move by forming a double kink along their length followed by expansion of the double kink. Nucleation of a double kink requires high activation energy. The interaction between a dislocation and a nanoscale coherent-coplanar precipitate locally reduces the activation energy needed to form a double kink increasing the dislocation's mobility, thereby making the material more ductile.

Urakami and Fine [3, 4] developed a mathematical treatment of the effect of a solute atom or solute cluster misfit center on a nearby dislocation segment pinned at both ends in the spirit of Weertman's idea, showing that a nearby misfit center indeed provides sufficient twisting of screw dislocation to reduce the activation energy for plastic flow. Except in dilute solid solutions, the misfit centers are unlikely to be single atoms. Clusters of solute atoms are thought [3, 4] to be the BCC misfit centers causing solid-solution softening. Fine et al. demonstrated that nanoscale coherent and coplanar misfit centers in the BCC metals, such as enriched Cu clusters in the BCC matrix, provide sufficient twisting of nearby screw dislocations to enhance their mobility in the absence of insufficient thermal activation [5]. The twisting provides a mechanism for ductilizing steel and for improving impact toughness at low temperatures; and the nanoscale coherent and coplanar Cu precipitates in a ferritic matrix act as misfit centers [5]. In other words, the nanoscale precipitates have dual roles: they increase the flow stress at room temperature because of precipitation strengthening, but also decrease the flow stress at low temperatures because of the interaction between stress fields of these misfit centers with nearby screw dislocations. This interaction leads to a lower temperature dependence of flow stress and consequently to a lower DBTT [5] in the steels. This opens a new paradigm for the design of more ductile and more fracture-resistant alloys, as well as a way to decrease the DBTTs in other metals and related intermetallics.

In accordance with the purposes of this invention, this concept is extended to other materials in which a high Peierls stress limits the ductility. For example, hexagonal close-packed (HCP) metals, such as Mg, titanium (Ti), and zirconium (Zr), have easy slip (plastic flow) on the basal plane but difficult slip on prism and pyramid planes, i.e., the Pieirls stress is small for basal but large for prism and pyramid slip. Moving a large dislocation segment from one valley to the next when the Pieirls stress is large requires a high stress. A strain center near a dislocation exerts a force on a dislocation forming a kink in the dislocation line. A double kink can expand by slip on the easy basal plane. A small misfitting precipitate coherent and coplanar with the matrix helps form a double kink, thereby making an alloy of HCP metals with enhanced ambient-temperature formability and ductility.

Development of low-cost Mg alloys with sufficient strength and enhanced ductility at an ambient temperature will lead to significant energy savings by replacing Al alloys with lighter Mg alloys in vehicles, aircraft and satellites. This requires development of new hexagonal Mg alloys that can be formed into complex shapes at room temperature, instead of about 150-200° C. (required for mechanical forming) or about 650° C. (required for casting).

The poor ductility of Mg and its alloys at room temperature is due to its HCP crystal structure, which provides only two independent slip systems for easy plastic deformation. The homogenous deformation of polycrystalline metals requires five independent slip systems. Slip on the basal plane requires a small stress to move a dislocation from one energy valley to the next (the Peierls stress). In contrast, slip for example on the pyramidal or prismatic planes requires a slip component in the C direction. This results in very high Peierls stresses. Three more slip systems (in prismatic and pyramidal planes) should be activated for Mg alloys to be able to plastically deform at ambient temperatures without cracking and fracturing.

In order to remedy the lack of active slip systems at ambient temperatures, the invention provides, among other things, mechanisms to activate non-basal (prismatic and pyramidal) slip in Mg. In certain embodiments, Li or Ca is used as a solution softener for Mg alloys, mobilizing 'hard' prismatic and pyramidal slip at relatively low temperatures. Addition of Li to hexagonal Mg alloys improves the ductility and formability of Mg to some extent. The Peierls stress for the prismatic and pyramidal slip is reduced due to change in the electronic forces between atoms in the crystal structure. This raises the critical resolved shear stress (CRSS) for the basal slip and lowers the CRSS for the prismatic slip in hexagonal Mg, fulfilling the Mises-Taylor criterion for homogenous plastic deformation.

To achieve the Mg alloy of the invention with enhanced ambient-temperature formability and ductility, in certain embodiments, Li or Ca is first added into Mg, which reduces the Pieirls stress for the whole dislocation segment (as well as the density). Then, Zn is added to form nanoscale coherent co-planar slightly misfitting precipitates. The resultant Mg alloy gives the desired mechanical formability. In certain embodiments, the content of Li or Ca in the Mg alloy is not larger than about 5.0 wt % of the Mg alloy, while the content of Zn in the Mg alloy is not larger than about 10.0 wt % of the Mg alloy.

In one embodiment, the Mg alloy includes Mg, Li and Zn. In one embodiment the contents of Li and Zn in the Mg alloy are at most than about 3.0 wt % and about 6.0 wt %, respectively. In another embodiment, the contents of Li and Zn in the Mg alloy are at most about 2.4 wt % and about 5.1 wt %, respectively.

In another embodiment, the Mg alloy includes Mg, Ca and Zn. In one embodiment the contents of Ca and Zn in the Mg alloy are at most about 2.0 wt % and about 6.0 wt %, respectively. In another embodiment, the contents of Ca and Zn in the Mg alloy are at most about 1.0 wt % and about 1.0 wt %, respectively.

In another aspect, the invention relates to an alloy. In one embodiment, the alloy includes a first element comprising a metal having an HCP crystal structure with a basal slip system and non-basal slip systems, where the non-basal slip systems include a prismatic and pyramidal slip, a second element adapted to activate the non-basal slip systems by mobilizing the prismatic and pyramidal slip, and a third element adapted to form nanoscale precipitates in the alloy so as to enhance ambient-temperature formability and ductility of the alloy. The nanoscale precipitates are of nanoscale coherent and co-planar misfit precipitates.

In one embodiment, the content of the second element is at most about 5.0 wt % of the magnesium alloy, and the content of the third element is at most about 10.0 wt % of the magnesium alloy.

In one embodiment, the first element comprises magnesium or titanium. In one embodiment, the second element comprises a non-HCP metal. In one embodiment, the second element comprises lithium or calcium, and the third element comprises zinc.

In certain aspects, the invention relates to a method to improve ambient-temperature ductility of HCP metal alloys, such as Mg alloys or Ti alloys, by incorporation of nanometer-sized (nanoscale) precipitates into the matrix crystal structure. According to the invention, a nanometer-sized precipitate or cluster produces a torque on a nearby dislocation, thereby reducing the Peierls stress and increasing its mobility. The disclosed alloys and method of forming the same achieve dramatic improvements of formability for the HCP metal alloys. In certain embodiments the cast Mg alloys are formed with additions of Li and Zn, or additions of Ca and Zn, and then solutionized at a temperature of about 350° C. for five days to dissolve the massive intermetallic particles in the casting. Solutionizing was followed immediately by water quenching to preserve the super saturated solid solution. The under-aged condition was selected to be 4 hours at 150° C. The peak-aged condition was selected to be 35 hours at 150° C.

Referring to FIG. 1, the method of forming an alloy is shown according to one embodiment of the present invention. In the exemplary embodiment, the method includes the following steps: at first, a molten mass of the first element, the second element and the third element is formed at step 110.

The first element includes a metal having a hexagonal close-packed (HCP) crystal structure with a basal slip system and non-basal slip systems. The non-basal slip systems comprise a prismatic and pyramidal slip. In certain embodiments, the first element comprises Mg, Ti, Zr, chromium (Cr), and nickelaluminum (NiAl), or the like.

The second element is adapted to activate the non-basal slip systems by mobilizing the prismatic and pyramidal slip. In one embodiment, the second element comprises a non-HCP metal. For example, in certain embodiments, the second element comprises Li, Ca, manganese (Mn), or aluminum (Al), or a combination thereof.

The third element is adapted to form the nanoscale precipitates in the alloy for enhancing ambient-temperature formability and ductility of the alloy. In certain embodiments, the third element comprises zinc.

According embodiments of the invention, the Mg alloy includes addition of Li or Ca for reducing the Peierls stress for a dislocation segment by mobilizing a prismatic and pyramidal slip, and addition of Zn as nano-scale coherent co-planar misfit precipitates.

Generally, it would work for any alloy system with precipitates that are co-planar and small.

In one embodiment, the forming step (step 110) comprises the step of adding an amount of the second element into an alloy of the first element to form an alloy of the first and second elements; and adding an amount of the third element in the alloy of the first and second elements.

In one embodiment, the content of the second element is at most about 5.0 wt % of the alloy, and the content of the third element is at most about 10.0 wt % of the alloy.

In one embodiment, the content of the lithium is at most about 3.0 wt % of the alloy, and the content of the zinc is at most about 6.0 wt % of the alloy.

In another embodiment, the content of the lithium is at most about 2.4 wt % of the alloy, and the content of the zinc is at most about 5.1 wt % of the alloy.

In one embodiment, the content of the calcium is at most about 2.0 wt % of the alloy, and the content of the zinc is at most about 6.0 wt % of the alloy.

In another embodiment, the content of the calcium is at most about 1.0 wt % of the alloy, and the content of the zinc is at most about 1.0 wt % of the alloy.

At step 120, the molten mass is cooled to form a solid mass of the alloy structure. Next, at step 130, the solid mass is solutionized to dissolve the massive intermetallic particles in the solid mass at a first temperature for a first period of time, immediately followed by water-quenching to preserve the super saturated solid solution. In certain embodiments, the first temperature is in a range of about 300-400° C., preferably, about 350° C., and the first period of time is in a range of about 72-168 hours, preferably, about 120 hours.

At step 140, the water-quenched mass is heat-treated at a second temperature for a second period of time to form nanoscale precipitates in the alloy. In certain embodiments, the second temperature is in a range of about 100-200° C., preferably, about 150° C., and the second period of time is in a range of about 1-50 hours, preferably, about 4-35 hours. After such heat treatment that led to the formation of the nanometer-sized precipitates, the nanometer-sized precipitate or cluster produces a torque on a nearby dislocation, thereby reducing the Peierls stress and increasing the mobility of the alloy.

According to the present invention, the nanoscale coherent and coplanar misfit precipitates serves as a strain center near the dislocation segment by exerting a force on the dislocation segment to form a kink in a dislocation line, where the condition for forming the kink in a dislocation line is predicted by the theory for the effect of the misfit precipitates to twist the dislocation segment locally for the dislocation segment to move spontaneously to a next energy valley, thereby enhancing mobility of the dislocation segment, increasing the number of available slip systems in the HCP metal alloy at ambient temperature and improving fracture toughness at low temperatures, resulting in lower DBTT, higher fracture energies and reduced Peierls stress.

According to the present invention, the Peierls stress for the prismatic and the pyramidal slip is reduced due to change in the electronic forces between atoms in the crystal structure, and the reduction of the Peierls stress for the prismatic and the pyramidal slip leads to raising of a CRSS for the basal slip system and lowering the CRSS for the prismatic and pyramidal slip, fulfilling the Mises-Taylor criterion for homogenous plastic deformation.

In one embodiment, the nano-scale coherent co-planar misfit precipitates help to form a double kink, which can expand by slip on an easy basal plane in the basal slip system, thereby making a ductile magnesium alloy.

Without intent to limit the scope of the invention, the exemplary embodiments are described below.

Figure 2:
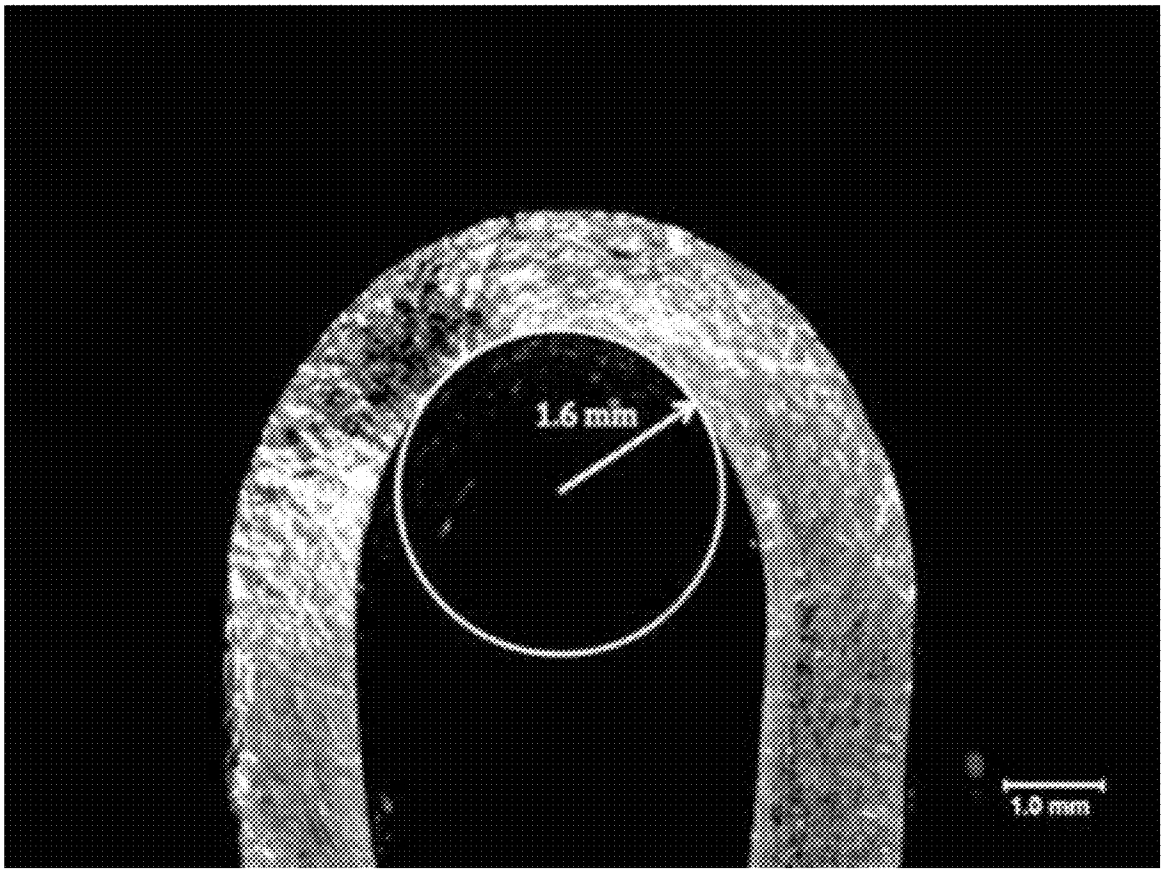
FIG. 2 shows a hand-bent specimen of an Mg-2.4Li-5.1Zn alloy in an under-aged condition according to one embodiment of the present invention.

FIG. 2 demonstrates that an Mg-2.4Li-5.1Zn alloy in a under-aged condition according to one embodiment of the present invention. Mg-2.4Li-5.1Zn represents an alloy that has a primary element of Mg, the content of Li being at most about 2.4 wt % of the alloy, and the content of Zn being at most about 5.1 wt % of the alloy. As shown in FIG. 2, the Mg-2.4Li-5.1Zn alloy can be bent 180° without cracking. According to invention, the Mg alloy comprises an Mg matrix crystal structure with a basal slip system and non-basal slip systems, where the non-basal slip systems include a prismatic and pyramidal slip; Li was added to Mg to reduces the Peierls stress for dislocation segments by mobilizing the prismatic and pyramidal slip; and Zn was added to Mg to form nanoscale coherent co-planar slightly misfit precipitates in the Mg matrix crystal structure.

Figure 3:
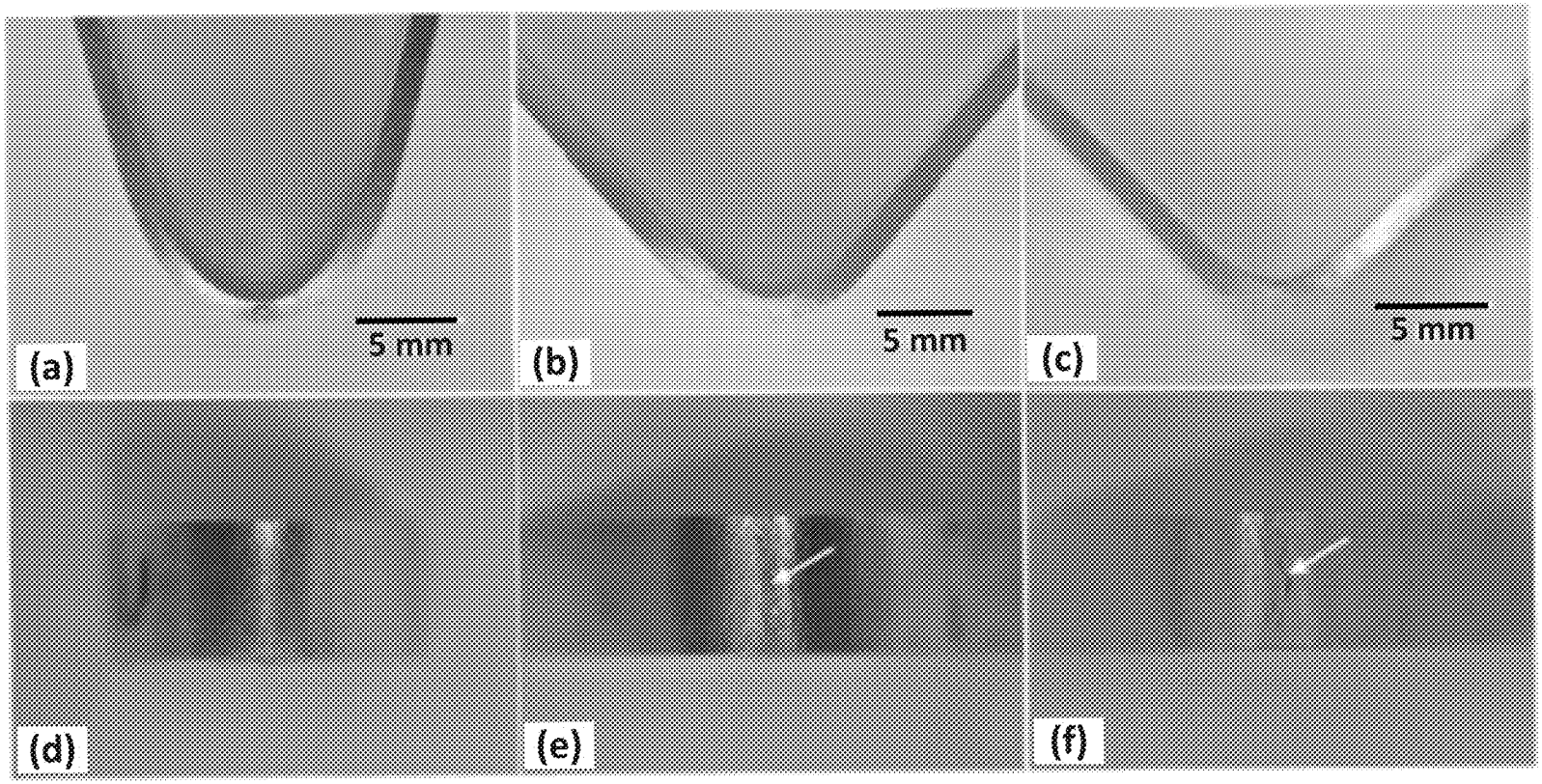
FIG. 3 shows bent three-point bending specimens of (a, d) Mg-2.4Li-5.1Zn in a under-aged condition; (b, e) Mg-2.4Li-5.1Zn in a peak-aged conditions; and (c, f) Mg-2.5Li as an existing reference alloy according to one embodiment of the present invention.

FIG. 3 shows bent three-point bending specimens of (a, d) the Mg-2.4Li-5.1Zn alloy in the under-aged condition; (b, e)

the Mg-2.4Li-5.11Zn alloy in the peak-aged conditions; and (c, f) an Mg-2.5Li alloy as an existing reference alloy. FIG. 3 demonstrates that (1) the Mg-2.5Li alloy cracked when bent to approximately 90° (c, f); (2) the Mg-2.4Li-5.11Zn alloy in the peak-aged condition when bent to approximately 90° was less cracked than the Mg-2.5Li alloy; and (3) the Mg-2.4Li-5.1Zn alloy in the under-aged condition did not form cracks when bent to approximately 130°. The disclosed data show that the alloy according to this embodiment of the invention (Mg 2.4 Wt. % L-5.1 Wt. % Zn) achieves the microstructure required need for the Weertman Effect to occur, exhibiting small nanoscale precipitates coherent and coplanar with the matrix.

Figure 4:
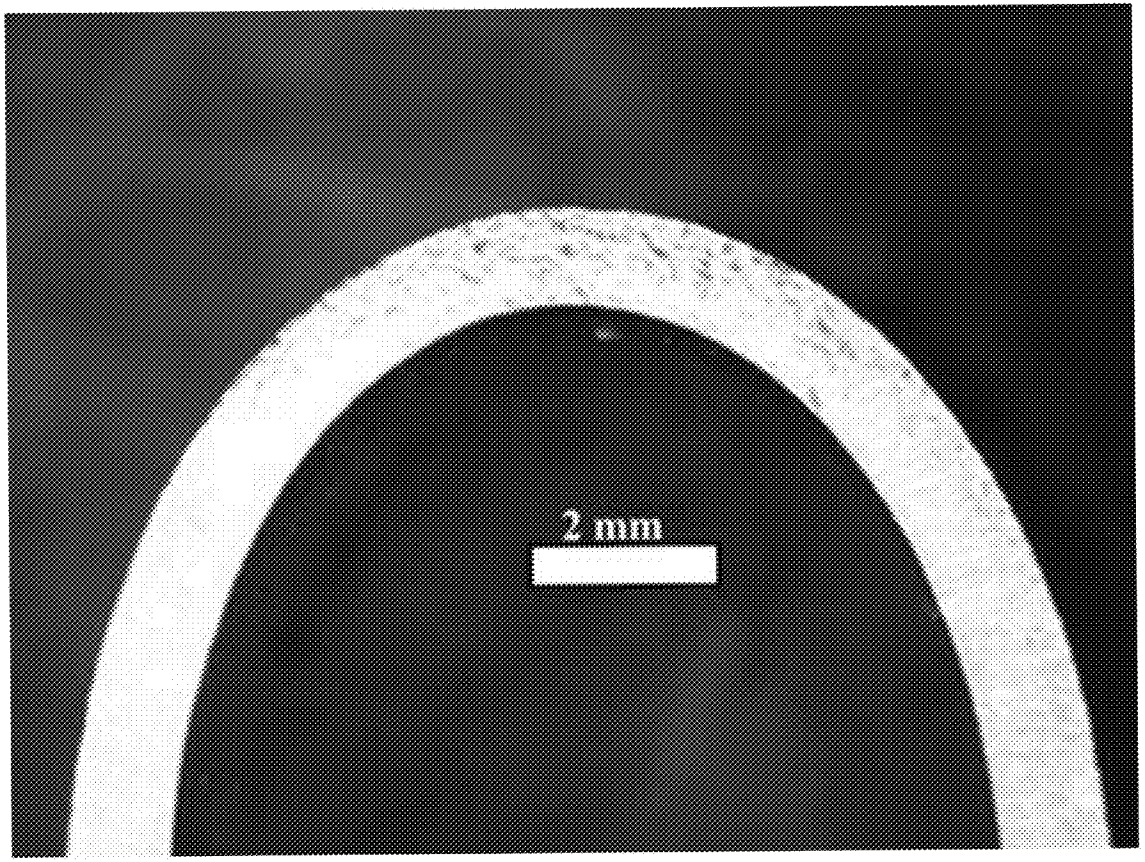
FIG. 4 shows an Mg-0.6 wt. % Ca-0.9 wt % Zn alloy plate (1.2 mm thick) bent about 180° around a mandrel at room temperature according to one embodiment of the present invention.

FIG. 4 shows that an Mg-0.6Ca-0.9Zn alloy plate (about 1.2 mm thick) bent 180° around a mandrel at room temperature according to another embodiment of the present invention. Mg-0.6Ca-0.9Zn represents an alloy that has a primary element of Mg, the content of Ca being at most about 0.6 wt % of the alloy, and the content of Zn being at most about 0.9 wt % of the alloy. The alloy was homogenized at about 470° C. for about 4 hours and then "slow" quenched in water. Excellent room temperature formability was recently found in the magnesium alloy with about 0.90 wt. % Zn and about 0.55 wt. % Ca alloy (0.3 at. % Ca, 0.3 at. % Zn). After solution treatment and slow quench specimen could be bent around a mandrel at room temperature without fracturing as shown in FIG. 4. As with the Mg—Li—Zn alloy, this alloy is ductile when it is under-aged, i.e., "slow" quenched or aged for a short time. The Mg alloys when aged to peak hardness (strength) are brittle when formed or bent at room temperature.

In addition, according to embodiments of the invention, other Mg alloys, for example, an MgAlZnCa alloy (i.e., an Mg alloy with additions of Al, Ca and Zn), and an MgLiCaZn alloy (i.e., an Mg alloy with additions of Li, Ca and Zn), also have enhanced ambient-temperature formability and ductility.

The invention recites, among other things, alloys incorporating nanoscale coherent and coplanar precipitates that lower the energy for dislocation movement and increase the number of available slip systems in the alloys at room temperature, and hence improve ductility and formability.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope as is discussed and set forth above and below including claims and drawings. Furthermore, the embodiments described above and claims set forth below are only intended to illustrate the principles of the present invention and are not intended to limit the scope of the invention to the disclosed elements. Accordingly, the scope of the present invention is defined by the appended claims rather than the foregoing description and the exemplary embodiments described therein.

LISTING OF REFERENCES

[1]. J. Weertman: Phys. Rev., 1956, vol. 101, pp. 1429-30.
[2]. J. Weertman: J. Appl. Phys., 1958, vol. 29, pp. 1685-87.
[3]. A. Urakami: Ph.D. Dissertation, Northwestern University, Evanston, Ill., 1970.
[4]. A. Urakami and M. E. Fine: Scripta Metall., 1970, vol. 4, pp. 667-72.
[5]. M. E. Fine, S. Vaynman, D. Isheim, Y-W. Chung, S. P. Bhat, C. H. Hahin: Metall. Mater. Trans. A, 2010, vol. 41A, pp. 3318-25.

What is claimed is:

1. An alloy, comprising:

a first element comprising a metal having a hexagonal close-packed (HCP) crystal structure with a basal slip system and non-basal slip systems, wherein the non-basal slip systems include a prismatic and pyramidal slip, wherein the metal comprises, chromium, or nickelaluminum (NiAl);

a second element comprising calcium and aluminum; and a third element, wherein the content of the second element is at most 5.0 wt % of the alloy, the content of the third element is at most 10.0 wt % of the alloy, and the content of the chromium, or NiAl is in balance of the alloy and is at least 85 wt % of the alloy;

wherein the content of the aluminum is at most 5.0 wt % of the alloy; and wherein the third element comprises zinc.

2. The alloy of claim 1, wherein the content of the zinc is at most about 6.0 wt % of the alloy.

3. An alloy, comprising:

a first element comprising a metal having a hexagonal close-packed (HCP) crystal structure with a basal slip system and non-basal slip systems, wherein the non-basal slip systems include a prismatic and pyramidal slip, wherein the metal comprises chromium, or nickelaluminum (NiAl);

a second element comprising at least aluminum, wherein the content of the aluminum is at most 5.0 wt % of the alloy; and a third element, wherein the content of the third element is at most 10.0 wt % of the alloy, wherein the content of the chromium, or NiAl is in balance of the alloy and is at least 85 wt % of the alloy, and wherein the third element comprises zinc.

* * * * *